US006884116B2

(12) United States Patent
Suzuki et al.

(10) Patent No.: US 6,884,116 B2
(45) Date of Patent: Apr. 26, 2005

(54) SURFACE-MOUNT ELECTRICAL CONNECTOR HAVING SHELL WITH FRONT AND REAR MOUNTING POSTS FORMED ADJACENT FRONT AND REAR ENDS OF THE SHELL

(75) Inventors: Mamoru Suzuki, Akishima (JP); Isao Igarashi, Akishima (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/454,955

(22) Filed: Jun. 5, 2003

(65) Prior Publication Data

US 2003/0228800 A1 Dec. 11, 2003

(30) Foreign Application Priority Data

Jun. 7, 2002 (JP) ..... 2002-167307

(51) Int. Cl.[7] ..... H01R 13/648
(52) U.S. Cl. ..... 439/607; 439/79
(58) Field of Search ..... 439/607–610, 439/79, 108

(56) References Cited

U.S. PATENT DOCUMENTS 5,637,014 A * 6/1997 Sukegawa et al. ..... 439/607
5,928,035 A * 7/1999 Jankowsky et al. ..... 439/607
5,993,258 A * 11/1999 Matsunuma et al. ..... 439/607
6,083,046 A * 7/2000 Wu et al. ..... 439/607
6,220,895 B1 * 4/2001 Lin ..... 439/607
6,322,395 B1 * 11/2001 Nishio et al. ..... 439/607
6,508,678 B1 * 1/2003 Yang ..... 439/677

FOREIGN PATENT DOCUMENTS

JP 11-026105 1/1999
JP 2000-357550 12/2000

* cited by examiner

*Primary Examiner*—Hien Vu
(74) *Attorney, Agent, or Firm*—Michael Best & Friedrich LLP

(57) ABSTRACT

A shell (30) included in an electrical connector has a top wall (40) having a first front end (40*a*), a bottom wall (42) having a second front end (42*a*1, 42*b*1), and side walls (44) having third front ends (44*a*), respectively. The first to the third front ends (40*a*, 42*a*1, 42*b*1, 44*a*) constitutes a front edge (31) of the shell (30), the front edge (31) defining an opening for receiving another shell of a mating connector inserted along an insertion direction into the shell (30). From the front edge (31), a pair of front mounting posts (33) continues rearwardly in the insertion direction and extends downwardly in a vertical direction below the bottom wall (42). Adjacent to a rear end (32) opposite to the front edge (31), a pair of rear mounting posts (34) is provided. Each of the rear mounting posts (34) is spaced from the corresponding front mounting post (33) in the insertion direction and extends downwardly in the vertical direction below a plane on which the bottom wall (42) is laid.

8 Claims, 3 Drawing Sheets

SURFACE-MOUNT ELECTRICAL CONNECTOR HAVING SHELL WITH FRONT AND REAR MOUNTING POSTS FORMED ADJACENT FRONT AND REAR ENDS OF THE SHELL

This invention claims priority to prior application JP 2002-167307, the disclosure of which is incorporated herein by reference.

BACKGROUND OF THE INVENTION

This invention relates to an electrical connector for surface mounting on a circuit board and, in particular, to a structure of a shell in the electrical connector.

JP-A 11-26105 discloses an electrical connector having a folded sheet metal shell, which comprises a pair of front mounting posts and a pair of rear mounting posts in order to securely fix the electrical connector onto a circuit board. The front mounting posts are connected to plate-like arms which extend forward from a rear end of the shell along side walls of the shell. Each of the plate-like arms is formed with an aperture which is positioned near to the front mounting post. To position the respective front mounting posts and keep their positions, the apertures are engaged with engagement portions which are provided for the side walls by making cuts into the side walls.

For highly reliable fixation of the connector onto the circuit board, it is preferable that the front mounting posts are positioned as close to a front end of the shell as possible. In addition, it is further preferable that there is a large distance between the front and the rear mounting posts.

However, the disclosed shell has a problem on its fixation. In order to form the front mounting posts closer to the front end of the shell, the corresponding plate-like arm inevitably becomes long. The long plate-like arm is a wasted part because the plate-like arm serves only to support the front mounting post but does not provide any effects for the shell.

In addition, the shell has another problem on its electromagnetic property. The plate-like arm is a cantilever having a free end, to which the front mounting post is connected. The engagement portion formed in the side wall is a necessary part for keeping the position of the front mounting post. On the other hand, the engagement portion is formed in the side wall by making a cut into the side wall as mentioned above. The cut degrades the electromagnetic property of the shell, i.e. a shielding function of the shell.

There is a need for a shell having front mounting posts and rear mounting posts, wherein the front mounting posts are positioned as near to a front end of the shell as possible without causing problems as mentioned above.

SUMMARY OF THE INVENTION

It is an object of the present invention to provide an electrical connector having a shell which is provided with front mounting posts near a front end of the shell while meeting the need mentioned above.

This invention is applicable to an electrical connector for surface mounting on a circuit board, which comprises a plurality of contacts, an insulator holding the contacts, and a shell surrounding the insulator. According to the invention, the shell comprises a front edge defining an opening for receiving a mating shell of a mating connector inserted along an insertion direction into the shell; a pair of front mounting posts each of which continues from the front edge and extends downwardly; and a pair of rear mounting posts for fixedly mounting the shell onto the circuit board in cooperation with the front mounting posts. Each of the rear mounting posts is spaced from the corresponding front mounting post in the insertion direction and extends downwardly.

According to an embodiment of this invention, the shell has a rear end opposite to the front edge in the insertion direction, and the rear mounting posts are positioned adjacent to the rear end.

According to another embodiment, the shell has a top wall having a first front end, a bottom wall having a second front end, and side walls having third front ends, respectively. The side walls are spaced from each other in a lateral direction perpendicular to the insertion direction and connects the top and the bottom walls in a vertical direction perpendicular to the insertion direction and to the lateral direction. The first to the third front ends constitute the front edge. Each of the front mounting posts is connected to the corresponding third front end.

DESCRIPTION OF PREFERRED EMBODIMENTS

Figure 1:
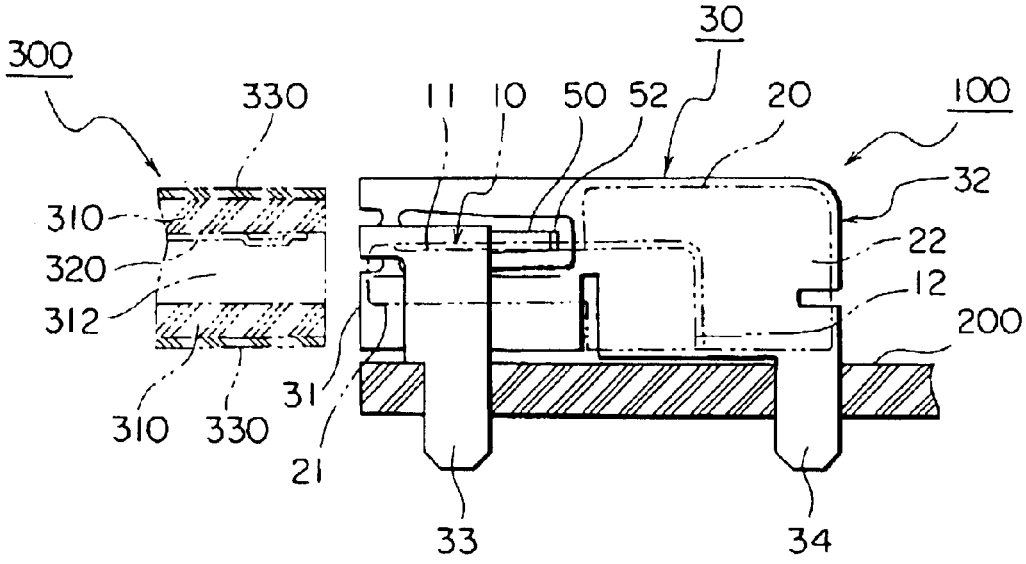
FIG. 1 is a side view showing a connector according to an embodiment of the present invention and a mating connector.
Figure 2:
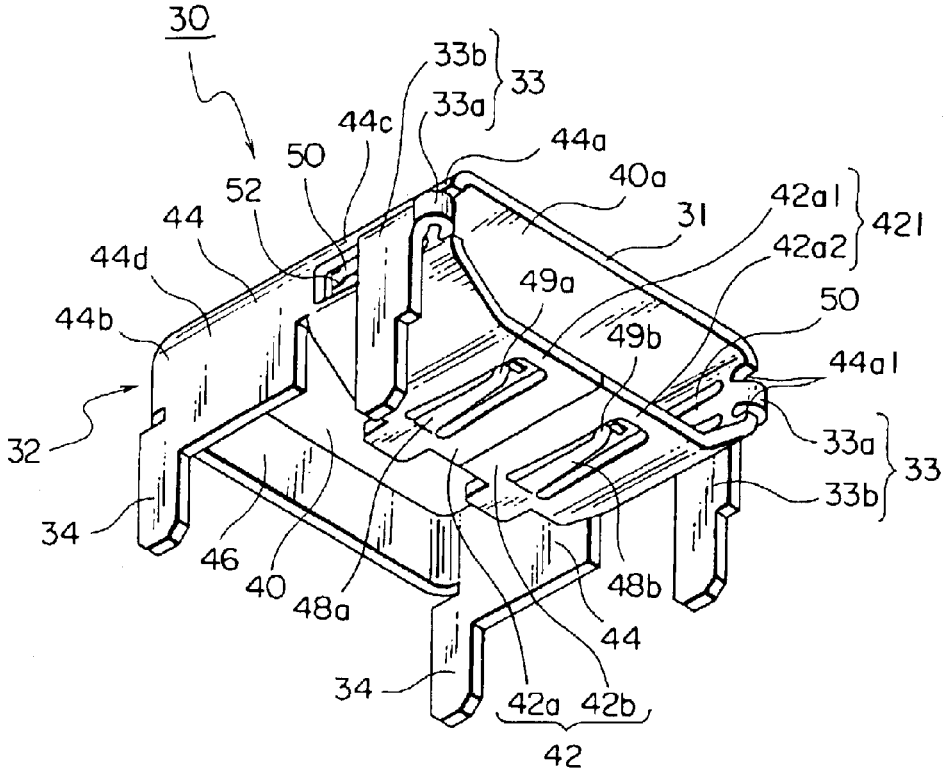
FIG. 2 is a perspective view showing a shell included in the connector of FIG. 1.
Figure 3:
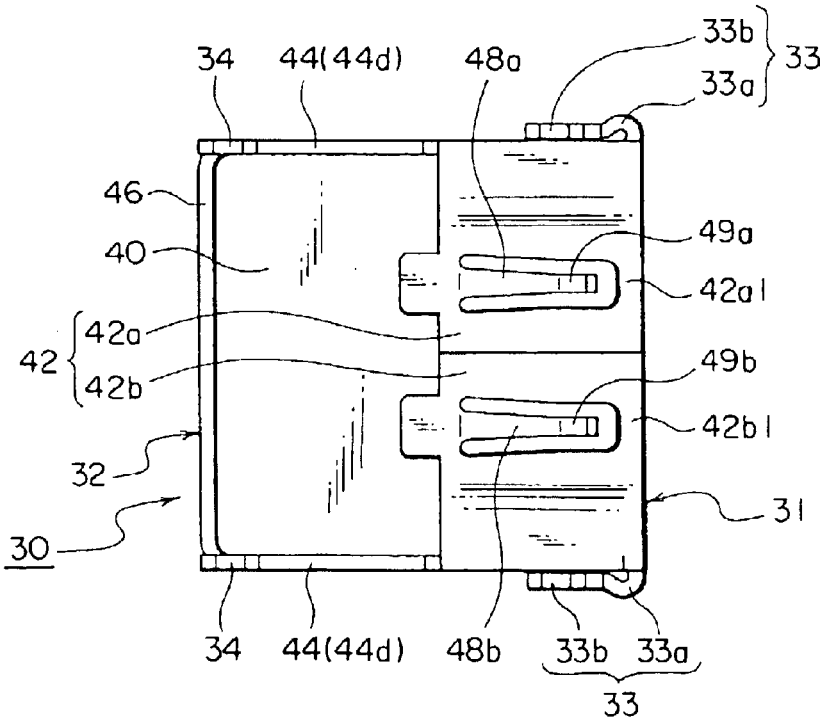
FIG. 3 is a bottom view showing the shell of FIG. 2.
Figure 4:
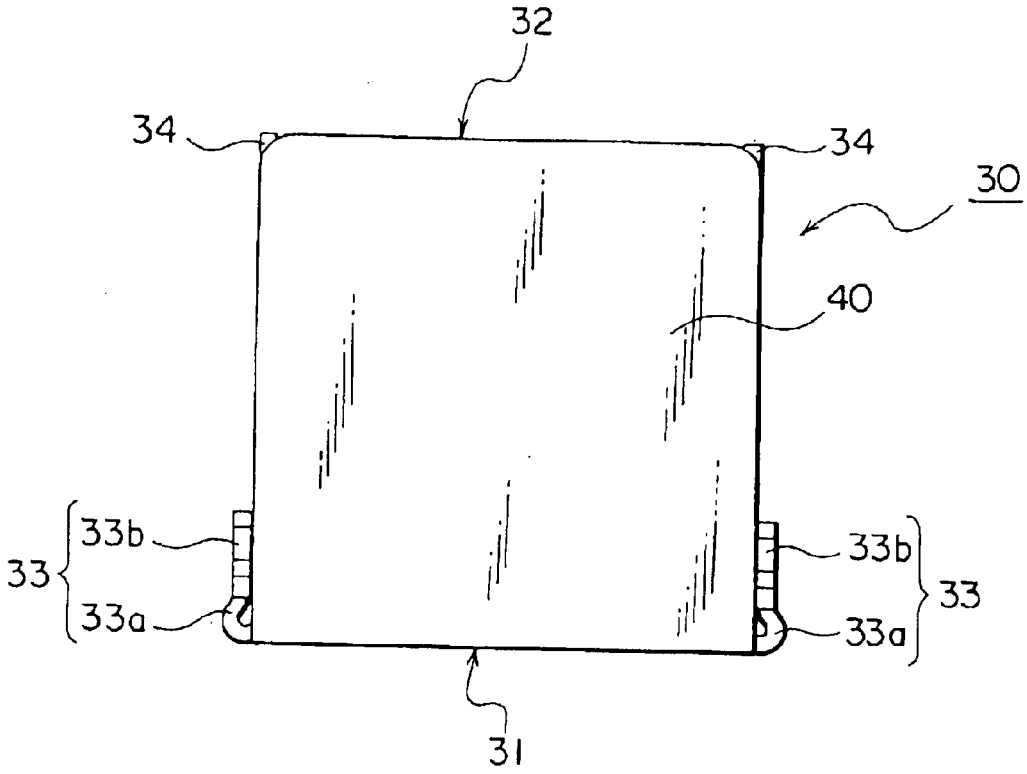
FIG. 4 is a top view showing the shell of FIG. 2.
Figure 5:
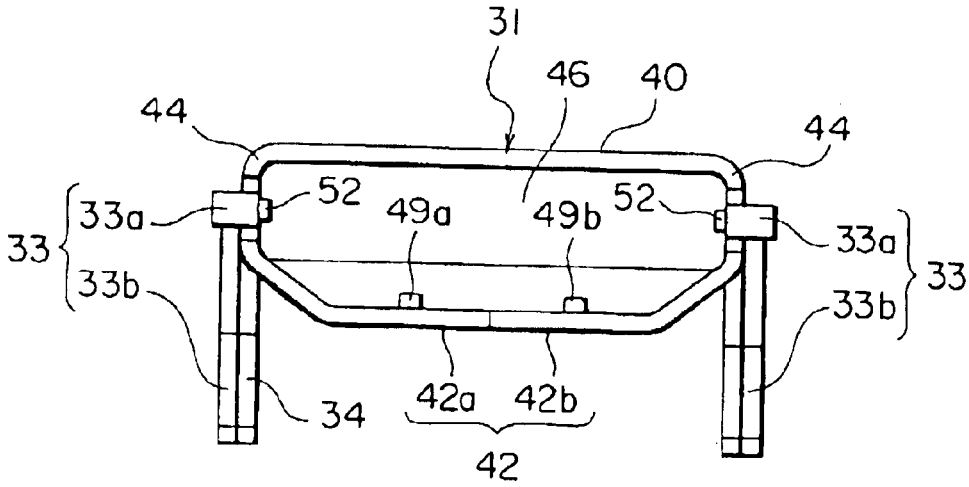
FIG. 5 is a front view showing the shell of FIG. 2.

With reference to FIG. 1, an electrical connector 100 according to one embodiment of the present invention is a surface mountable connector on a circuit board 200, such as a printed circuit board. The electrical connector generally comprises a plurality of contacts 10, an insulator 20 holding the contacts 10, and a shell 30 surrounding the insulator 20. In this embodiment, the insulator 20 is comprised of a front portion 21 and a rear portion 22, wherein the sectional profile of the front portion 21 is thinner than that of the rear portion 22. Each of the contacts 10 has a contact portion 11 extending in a longitudinal direction of the connector 100 and a terminal end 12 to be connected to a circuit formed on the circuit board 200. The contact portion 11 is arranged in the upper surface of the front portion 21 of the insulator 20.

The shell 30 is fabricated by stamping out, forming, and folding up from a single sheet of metal material. That is, the shell 30 according to this embodiment is a folded sheet metal shell. The shell 30 has a front edge 31 defining an opening and a rear end 32 opposite to the front edge 31 in the longitudinal direction. Through the opening defined by the front edge 31, the front portion 21 of the insulator 20 and the contacts 10 can be seen.

In order to securely fix the electrical connector 100 onto the circuit board 200, the shell 30 comprises a pair of front mounting posts 33 and a pair of rear mounting posts 34. The front mounting posts 33 continue from the front edge 31 in the longitudinal direction, while extending in a vertical direction perpendicular to the longitudinal direction. The rear mounting posts 34 are spaced from the respective front mounting posts 33 in the longitudinal direction and are positioned adjacent to the rear end 32. In this embodiment, the front and rear mounting posts 33, 34 are inserted into through holes or slits formed in the circuit board 200, so that the electrical connector 100 is fixedly mounted on the circuit board 200. However, the front and rear mounting posts 33, 34 may be modified so that they have bent shapes and are to be connected to pads formed on the circuit board 200. In consideration of the various modifications a person skilled in the art can reach easily, the term "mounting post" also includes one having a bent shape or a shape other than a straight or flat plate-like shape.

A mating connector 300 to be mated with the connector 100 has an insulator, a plurality of contacts and a shell, which are referred to as a mating insulator 310, mating contacts 320 and a mating shell 330, in order to distinguish them from the insulator 20, the contacts 10 and the shell 30 of the connector 100.

The mating insulator 310 defines an accommodation space 312, which accommodates the front portion 21 of the insulator 20 when the mating connector 300 is mated with the connector 100. The mating contacts 320 are arranged on the upper-inner surface of the mating insulator 310 so that, when the front portion 21 of the connector 100 is accommodated in the mating insulator 310, the mating contacts 320 are brought into contact with the contacts 10. The mating shell 330 covers the mating insulator 310 and is to be inserted into and fitted with the shell 30. In this connection, the longitudinal direction of the connector 100 is also referred to as an insertion direction in the present application. The mating insulator 310 and the mating shell 330 are sized such that the mating shell 330 can be tightly inserted into the shell 30 through the opening thereof, while the mating insulator 310 can accommodate the front portion 21 to make electrical connections suitable.

With reference to FIGS. 2 to 5, the structure of the shell 30 is explained in detail.

The shell 30 has a top wall 40, a bottom wall 42, side walls 44 and a rear wall 46. The top wall 40 has a first front end 40*a*. The bottom wall 42 is opposite to the top wall 40 in the vertical direction. The bottom wall 42 has about half size of the top wall 40 in the insertion direction and also has a smaller size than the top wall 40 in a lateral direction perpendicular to the insertion direction and to the vertical direction. The bottom wall 42 has a second front end 421. The side walls 44 are spaced from each other in the lateral direction. The side walls 44 have third front ends 44*a* and rear ends 44*b*, respectively. The first to the third front ends 40*a*, 421, 44*a* constitute the front edge 31 of the shell 30 to form a tubular enclosure. The rear wall 46 connects between the rear ends 44*b* of the side walls 44 in the lateral direction so that it constitutes the rear end 32 of the shell 30.

The bottom wall 42 is comprised of two wall parts 42*a*, 42*b*, which are disposed on the same plane. The edges of the wall parts 42*a*, 42*b* in the lateral direction abut on each other. Each of the wall parts 42*a*, 42*b* is provided with a lower spring tongue 48*a*, 48*b*, which has a free end nearer to the front end than to the rear end 32 of the shell 30. The free end of the lower spring tongue 48*a*, 48*b* is formed with a pressing projection 49*a*, 49*b* which projects toward the inside of the shell 30. The pressing projection 49*a*, 49*b* of the lower spring tongue 48*a*, 48*b* presses the mating shell 330 against the top wall 40 when the mating shell 330 is inserted into the shell 30. In other words, the lower spring tongue 48*a*, 48*b* serves to securely holding the mating shell 330 in the vertical direction in cooperation with the top wall 40 when the mating shell 330 is inserted into the shell 30.

Each of the side walls 44 has a front and a rear portions 44*c*, 44*d*. Each front portion 44*c* of the side wall 44 has a bent shape so as to connect the top wall 40 and the bottom wall 42 which is smaller than the top wall 40 in the lateral direction. The front portion 44*c* of the side wall 44 is provided with a side spring tongue 50, which has a free end nearer to the rear end 32 than to the front end of the shell 30. As clearly seen from FIG. 2, the free end of the side spring tongue 50 extends in the direction opposite to the free end of the lower spring tongue 48*a*, 48*b* extending. The free end of the side spring tongue 50 is formed with a pressing projection 52 which projects toward the inside of the shell 30. The pressing projection 52 presses the mating shell 330 toward the inside of the shell in the lateral direction when the mating shell 330 is inserted into the shell 30. In other words, the side spring tongue 50 serves to securely holding the mating shell 330 in the lateral direction in cooperation with the other side spring tongue 50 when the mating shell 330 is inserted into the shell 30.

Each rear portion 44*d* of the side wall 44 has a flat shape while not connected to the bottom wall 42 directly. Directory from the rear portion 44*d* of the side wall 44, the rear mounting post 34 extends downwardly in the vertical direction below a plane on which the bottom wall 42 is laid. The rear mounting post 34 has also a flat shape laid on the same plane as the rear portion 44*d* of the side wall 44. In this embodiment, the rear mounting post 34 is not connected to the rear wall 46 directly but via the rear portion 44*d* of the side wall 44. However, the rear mounting post 34 may be connected to the rear wall 46 directly.

Each of the front mounting posts 33 has a folded portion 33*a* and a flat plate like elongated portion 33*b*. The folded portion 33*a* continues from the corresponding third front end 44*a* of the side wall 44 and is curved rearwardly in the insertion direction. Specifically, the third front end 44*a* has two small cuts 44*a*1 to make the folded portion 33*a* easily. The folded portion 33*a* is connected to the plate-like portion 33*b* in the insertion direction. The plate-like portion 33*b* extends downwardly in the vertical direction below the bottom wall 42, i.e. the corresponding wall part 42*a*, 42*b*, while partially facing the corresponding side wall 44 in the lateral direction. The plate-like portion 33*b* is laid on a plane parallel to the side wall 44 but different from the side wall 44 so that the plate-like portion 33*b* is laid on a plane different from that of the corresponding rear mounting post 34.

With the structure explained above, the front mounting posts 33 can be provided adjacent to the front edge 31 of the shell 30 without any wasted parts. In addition, because the front mounting post 33 is formed by a folding-up operation that does not need large cuts into the shell 30, the shell 30 can provide a good electromagnetic property, i.e. a good shielding function. Because the shell 30 has large distances between the front and the rear mounting posts 33, 34, the shell 30 becomes tolerant to a tilting force which is caused by an insertion of the mating shell 330 to the shell 30 with an unallowable angel.

Although the rear mounting post 34 is laid on a plane different from that of the corresponding front mounting post 33 in the above-mentioned embodiment, the rear mounting post 34 may be laid on the same plane as the corresponding front mounting post 33 by forming the rear mounting post 34 in a similar manner of the formation of the front mounting post 33.

What is claimed is:

1. An electrical connector for surface mounting on a circuit board, wherein the electrical connector comprises a plurality of contacts, an insulator holding the contacts, and a shell surrounding the insulator, wherein the shell comprises:

a front edge defining an opening for receiving a mating shell of a mating connector being inserted along an insertion direction into the shell;

a top wall having a first front end;

a bottom wall having a second front end;

side walls having third front ends each including small cuts formed thereof respectively, the side walls being spaced from each other in a lateral direction perpendicular to the insertion direction and connecting the top and the bottom walls in a vertical direction perpendicular to the insertion direction and to the lateral direction, the first, second and third front ends constituting the front edge;

a pair of front mounting posts, each of which continues from the front edge and extends downwardly, each of the front mounting posts being connected to the corresponding third front end between the small cuts thereof wherein each of the front mounting posts comprises a folded portion and a plate-like portion, the folded portion continuing from the corresponding third front end and curved rearwardly in the insertion direction, the plate-like portion connected to the folded portion in the insertion direction and extending downwardly in the vertical direction below the bottom wall, partially facing the corresponding side wall in the lateral direction; and a pair of rear mounting posts for fixedly mounting the shell onto the circuit board in cooperation with the front mounting posts, wherein each of the rear mounting posts is spaced from the corresponding front mounting post in the insertion direction and extends downwardly.

2. The electrical connector according to claim 1, wherein the shell has a rear end opposite to the front edge in the insertion direction, and the rear mounting posts are positioned adjacent to the rear end.

3. The electrical connector according to claim 1, wherein each of the rear mounting posts is connected to the corresponding side wall and extends from the corresponding side wall downwardly in the vertical direction.

4. The electrical connector according to claim 1, wherein each of the side walls has a front portion and a rear portion continuing from the front portion in the insertion direction, and the front portion is formed with a side spring tongue for securely holding the mating shell in the lateral direction when the mating shell is inserted into the shell through the opening defined by the front edge.

5. The electrical connector according to claim 1, wherein the bottom wall has at least one lower spring tongue for securely holding the mating shell in the vertical direction when the mating shell is inserted into the shell through the opening defined by the front edge.

6. The electrical connector according to claim 1, wherein the bottom wall is comprised of two parts, which continue from the respective side walls and are disposed on the same plane as each other.

7. The electrical connector according to claim 6, wherein the two parts of the bottom wall abut on or are fitted with each other.

8. The electrical connector according to claim 1, wherein the shell is a folded sheet metal shell obtainable by stamping out, forming and folding up from a single sheet of metal material.

* * * * *